US011101546B2

(12) United States Patent
Li

(10) Patent No.: US 11,101,546 B2
(45) Date of Patent: Aug. 24, 2021

(54) ELECTRONICAL DEVICE

(71) Applicant: Lenovo (Beijing) Co., Ltd., Beijing (CN)

(72) Inventor: Shichao Li, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 222 days.

(21) Appl. No.: 16/370,876

(22) Filed: Mar. 29, 2019

(65) Prior Publication Data

US 2019/0305404 A1 Oct. 3, 2019

(30) Foreign Application Priority Data

Mar. 30, 2018 (CN) ..... 201810298316.1

(51) Int. Cl.
*H01Q 1/24* (2006.01)

(52) U.S. Cl.
CPC ..... *H01Q 1/243* (2013.01)

(58) Field of Classification Search
CPC ..... H01Q 1/243; H01Q 1/44; H01Q 7/00; H01Q 13/10; H01Q 1/48; H01Q 9/42; H01Q 5/328; H01Q 1/38; H04M 1/026
See application file for complete search history.

(56) References Cited

U.S. PATENT DOCUMENTS

| | | | | |
|---|---|---|---|---|
| 10,629,982 | B2 * | 4/2020 | Kim | H04B 1/3888 |
| 2004/0222926 | A1 * | 11/2004 | Kontogeorgakis | H01Q 1/243 343/702 |
| 2017/0346164 | A1 * | 11/2017 | Kim | H01Q 13/10 |
| 2018/0076529 | A1 * | 3/2018 | Minard | H01Q 13/18 |

FOREIGN PATENT DOCUMENTS

| | | | |
|---|---|---|---|
| CN | 204668449 | U | 9/2015 |
| CN | 106374192 | A | 2/2017 |
| CN | 107453040 | A | 12/2017 |
| CN | 207053566 | U | 2/2018 |

* cited by examiner

*Primary Examiner* — Dameon E Levi
*Assistant Examiner* — David E Lotter
(74) *Attorney, Agent, or Firm* — Anova Law Group, PLLC

(57) ABSTRACT

The present disclosure discloses an electronic device having a first slot disposed along a side surface of the electronic device; and a first metal portion disposed on the side surface corresponding to the first slot being used as a radiator of a first antenna of the electronic device.

16 Claims, 13 Drawing Sheets

ELECTRONICAL DEVICE

CROSS-REFERENCES TO RELATED APPLICATIONS

This application claims the priority to Chinese Patent Application No. 201810298316.1, entitled "An Electronic Device," filed on Mar. 30, 2018, the entire content of which is incorporated herein by reference.

FIELD OF THE DISCLOSURE

The present disclosure relates to the field of electronics. More specifically, the present disclosure relates to an electronic device.

BACKGROUND

With the development of electronic technology, the use of full-screen electronic devices has attracted much attention and become mainstream development of the electronic devices. However, the development of the built-in antenna of the electronic devices has yet to make a breakthrough, and the radiation performance of the antenna of the electronic devices is constantly been affected by the decrease in the clearance area in these electronic devices, and the performance has not been satisfactory.

BRIEF SUMMARY OF THE DISCLOSURE

The embodiments of the present disclosure provide an electronic device to enhance the radiation performance of the antenna.

One aspect of the present disclosure provides an electronic device. The electronic device includes a first slot disposed along a side surface of the electronic device; and a first metal portion disposed on the side surface corresponding to the first slot being used as a radiator of a first antenna of the electronic device.

Another aspect of the present disclosure provides a method for extending a current path of a radiator of an antenna in an electrical device. The method includes the steps of placing a first slot disposed along a side surface of the electronic device; and placing a first metal portion on the side surface corresponding to the first slot being used as the radiator of a first antenna of the electronic device.

The embodiments of the electronic device use the first metal portion on the side of the electronic device as the radiator of the antenna, instead of the built-in radiator, thereby improving the radiation performance of the antenna of the electronic device due to the decreased clearance area.

BRIEF DESCRIPTION OF THE DRAWINGS

For a more complete understanding of the present disclosure, and the advantages thereof, reference is now made to the following descriptions to be taken in conjunction with the accompanying drawings.

DETAILED DESCRIPTION

Hereinafter, embodiments of the present disclosure will be described with reference to the accompanying drawings. It should be understood that such description is exemplary only but is not intended to limit the scope of the present disclosure. In addition, in the following description, descriptions of well-known structures and techniques are omitted to avoid unnecessarily obscuring the concepts of the present disclosure.

In the following description, numerous specific details will be set forth to provide sufficient understanding of the present disclosure, however the present disclosure may also be implemented by other ways different from the way described herein, similar modifications may be made by those skilled in the art without departing from the spirit of the present invention, therefore the present disclosure is not limited to particular embodiments disclosed hereinafter.

The terms used herein is for the purpose of describing particular embodiments only but is not intended to limit the present disclosure. The words "a", "an" and "the" as used herein should also cover the meanings of "a plurality of" and "a variety of", unless the context clearly dictates otherwise. In addition, the terms "comprising", "including", "containing" and the like as used herein indicate the presence of the features, steps, operations and/or components, but do not preclude the presence or addition of one or more other features, steps, operations or components.

All terms (including technical and scientific terms) used herein have the same meanings as commonly understood by the skilled in the art, unless defined otherwise. It should be noted that the terms used herein should be construed to have the same meanings as the context of the present specification and should not be interpreted in an idealized or overly stereotyped manner.

As mentioned above, the development of the built-in antenna of the electronic devices has yet to make a breakthrough, and the radiation performance of the antenna of the electronic devices is constantly been affected by the decrease in the clearance area in these electronic devices, and the performance has not been satisfactory.

Figure 1:
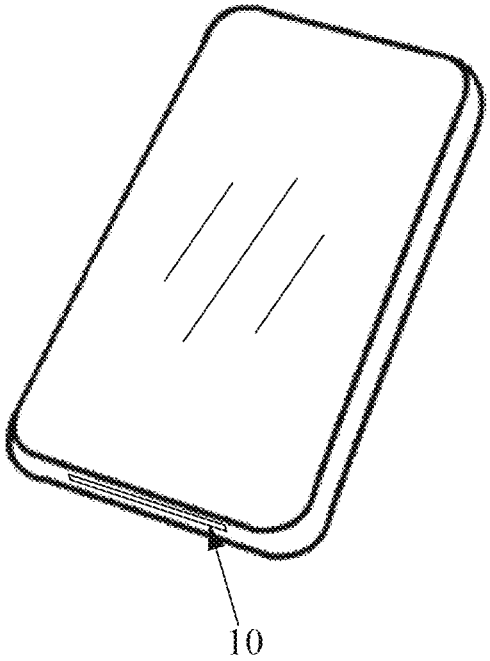
FIG. 1 is a schematic illustrating an electronic device according to an embodiment of the present disclosure.

One aspect of the present disclosure provides an electronic device. As shown in FIG. 1, the electronic device has a first slot 10 on a side surface of the electronic device. The first slot extends in the direction parallel to the upper surface of the electronic device, that is, the first slot does not extend from the upper surface to the lower surface of the electronic device. The portion of the side surface matching the first slot 10 is a first metal portion that may act as a radiator for the first antenna of the electronic device.

It should be noted that in the embodiments of the present disclosure, the matching of the first metal portion and the first slot may include cases where the first metal portion may be located at the first slot, or the first metal portion may be disposed around the first slot, or the first metal portion may be located on one side of the first slot, etc. The position of the first slot and the first metal is not limited as long as the first slot and the first metal portion may form an antenna structure.

As can be seen, the electronic device provided in the present disclosure uses the first metal portion of on the side surface of the electronic device as the radiator of the antenna instead of the built-in antenna, thereby improving the radiation performance of the antenna of the electronic device due to the decreased clearance area.

Further, in the electronic device provided by the embodiments of the present disclosure, the first slot may extend in the direction parallel to the upper surface of the electronic device so that the first metal portion on the side surface matching the first slot may also be disposed parallel to the upper surface of the electronic device to have a larger space as the length of the first metal portion, thereby extending the current path of the radiator of the antenna, and improving the radiation performance of the antenna of the electronic device.

Figure 2:
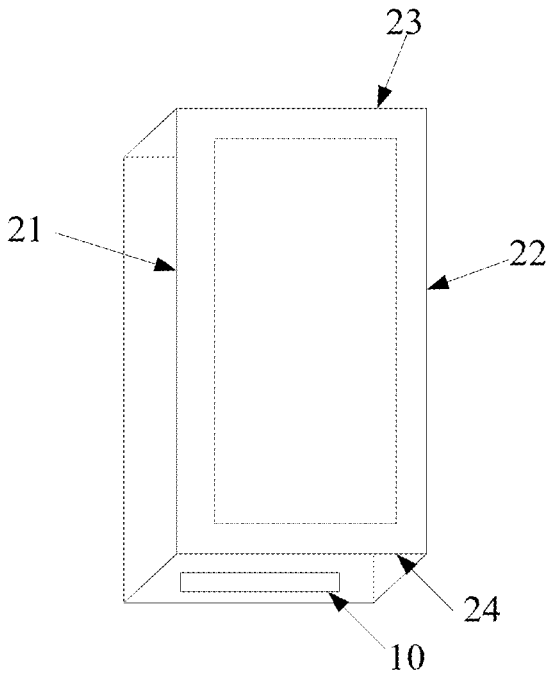
FIG. 2 is a schematic illustrating the electronic device according to another embodiment of the present disclosure.

Based on the above embodiment, in one embodiment of the present disclosure, the first slot may extend in the direction that is at least partially parallel to a predetermined edge which may be the connection line between the side surface and the upper surface of the electronic device. More specifically, in one embodiment, the electronic device may include four predetermined edges as shown in FIG. 2. When the display surface of the electronic device is facing upward, a first predetermined edge 21 may be formed by a connection line between the left side surface of the electronic device and the upper surface of the electronic device, and a second predetermined edge may be formed by the connection line between the right side surface of the electronic device and the upper surface of the electronic device. Further, a third predetermined edge 23 may be formed by the connection line between the top side surface of the electronic device and the upper surface of the electronic device, and a fourth predetermined edge 24 may be formed by the connection line between the bottom side surface of the device and the upper surface of the electronic device. In the present embodiment, the first slot may extend in the direction that is at least partially parallel to one predetermined edge where the first slot 10 may be at least partially parallel to the first predetermined edge 21, or the first slot 10 may be at least partially parallel to the second predetermined edge 22, or the first slot 10 may be at least partially parallel to the third predetermined edge 23, or the first slot 10 may be at least partially parallel to the fourth predetermined edge 24.

Figure 3:
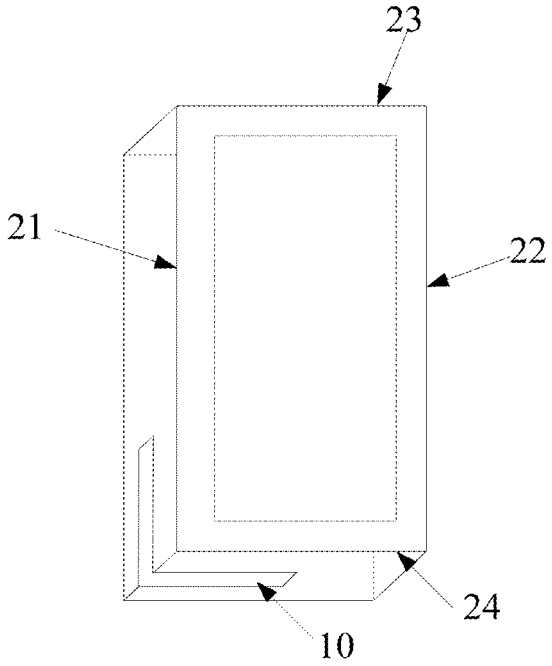
FIG. 3 is a schematic illustrating the electronic device according to yet another embodiment of the present disclosure.

It should be noted that in the embodiment above, the first slot 10 may only extend in the direction parallel to one predetermined edge. As shown in FIG. 2, the extension direction of the first slot 10 is parallel to the fourth predetermined edge 24. Further, the extension direction of the first slot 10 may be partially parallel to one predetermined edge while being parallel to another predetermined edge at the same time. As shown in FIG. 3, the extension direction of the first slot 10 is partially parallel to the first predetermined edge 21, and is also partially parallel to the fourth predetermined edge 24. The present disclosure does not limit the specific direction of the first slot 10 and it may be modified according to different use cases.

Figure 4:
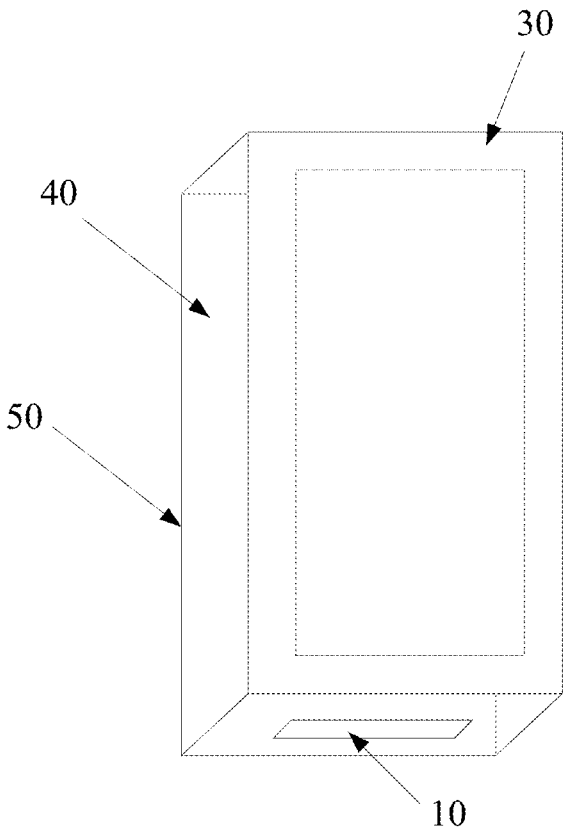
FIG. 4 is a schematic illustrating the electronic device according to still another embodiment of the present disclosure.
Figure 5:
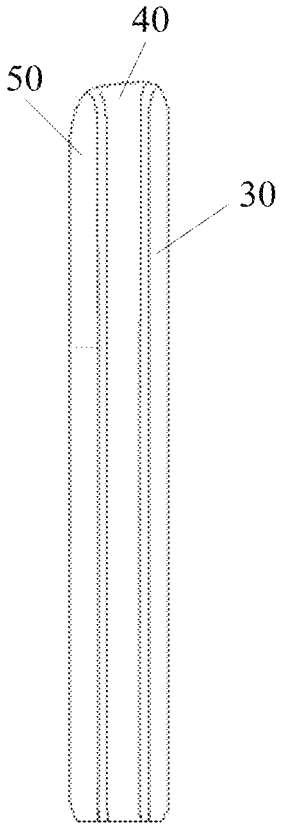
FIG. 5 is a side view of the electronic device shown in FIG. 4.

Based on the above embodiment, in one embodiment of the present disclosure as shown in FIG. 4 and FIG. 5, the electronic device may further include a protective surface 30 generally disposed on top of the display of the electronic device to protect the display; and a middle frame 40 disposed along the edge of the protective surface 30 to surround the protective surface 30. In the present embodiment, the side surfaces of the electronic device is the middle frame, that is, in the embodiment of the present disclosure, a rear case 50 and the side surfaces of the electronic device (i.e., the middle frame 40) are not integrated, and the rear case of the electronic device is only located at the back of the electronic device, the middle frame is located at the sides of the electronic device, and the first slot 10 is a slot on the middle frame 40. In one embodiment, the protective surface may be made of transparent glass.

Based on the above embodiment, in one embodiment of the present disclosure, the middle frame of the electronic device may be made of an insulating material, and the first metal portion may be located at the first slot, or may be disposed around the first slot. In another embodiment of the present disclosure, the middle frame of the electronic device may be made of a metal material, and the first metal portion may be located at the first slot, or may be disposed around the first slot. However, in the present disclosure, the middle frame may include a first isolation portion to isolate the first metal portion on the middle frame that matches the first slot. That is, the first isolation portion may be used to isolate the first metal portion from the rest of the metal portions on the middle frame.

More specifically, based on the above embodiment, in one embodiment of the present disclosure, when the middle frame of the electronic device is made of metal material, and the rear case of the electronic device is made of non-metal material, the first isolation portion may include a first isolation slot and a second isolation slot. Further, the first isolation slot may be in the direction from the upper surface of the electronic device to the lower surface of the electronic device, and extend through the middle frame. Furthermore, the second isolation slot may be in the direction from the upper surface of the electronic device to the lower surface of the electronic device, and extend through the middle frame. An isolation region may be formed between the first isolation slot and the second isolation slot, and the first metal portion may be disposed within the isolation region.

In another embodiment of the present disclosure, when the middle frame of the electronic device is made of metal material, and the rear case of the electronic device is also made of metal material, the first isolation portion may include the first isolation slot, the second isolation slot, and a third isolation slot. Further, the first isolation slot may be in the direction from the upper surface of the electronic device to the lower surface of the electronic device, and extend through the middle frame; the second isolation slot may be in the direction from the upper surface of the electronic device to the lower surface of the electronic device, and extend through the middle frame; and the third isolation slot may be disposed between the middle frame and the rear case of the electronic device. One end of the third isolation slot may be connected to the first isolation slot, and the other end may be connected to the second isolation slot, so the isolation region may be formed using the first isolation slot, the second isolation slot, and the third isolation slot. Further, the first metal portion may be disposed within the isolation region.

Figure 6:
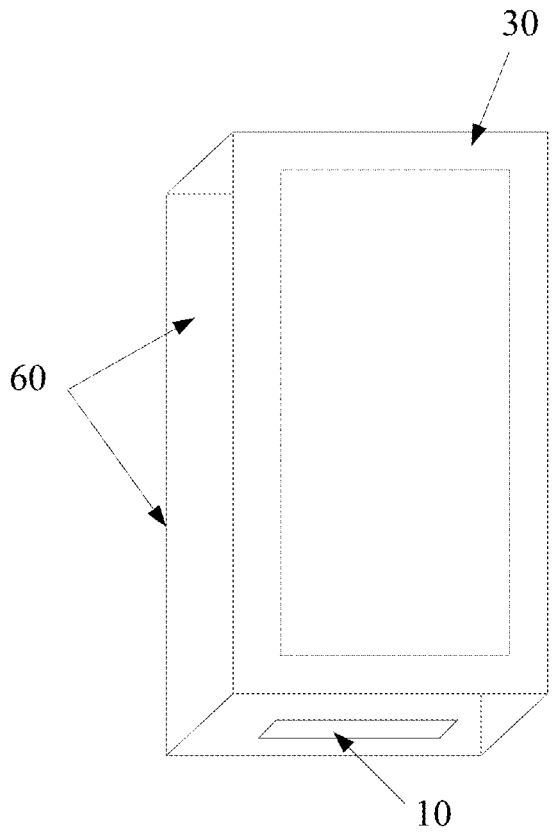
FIG. 6 is a schematic illustrating the electronic device according to yet another embodiment of the present disclosure.
Figure 7:
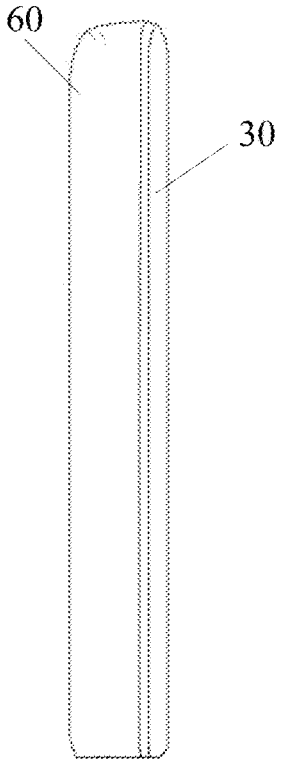
FIG. 7 is a side view of the electronic device shown in FIG. 6.

In another embodiment of the present disclosure, as shown in FIG. 6 and FIG. 7, the electronic device may include the protective surface 30 and a housing 60. The side walls of the housing 60 may surround the protective surface 30 along the edges of the protective surface 30. Further, the side surfaces of the electronic device may be the side walls of the housing 60, and the first slot may be a slot on the side wall of the housing 60. That is, in the embodiment of the present disclosure, the back surface and the side surfaces of the electronic device are integrated. Further, the protective surface 30 may be made of transparent glass.

Based on the above embodiment, in one embodiment of the present disclosure, the housing of the electronic device may be made of an insulating material, and the first metal portion may be located at the first slot, or may be disposed around the first slot. In another embodiment of the present disclosure, the housing of the electronic device may be made of a metal material, and the first metal portion may be located at the first slot, or may be disposed around the first slot. However, in the present disclosure, the housing may include a second isolation portion to isolate the first metal portion on the housing that matches the first slot. That is, the second isolation portion may be used to isolate the first metal portion from the rest of the metal portions on the housing.

Figure 8:
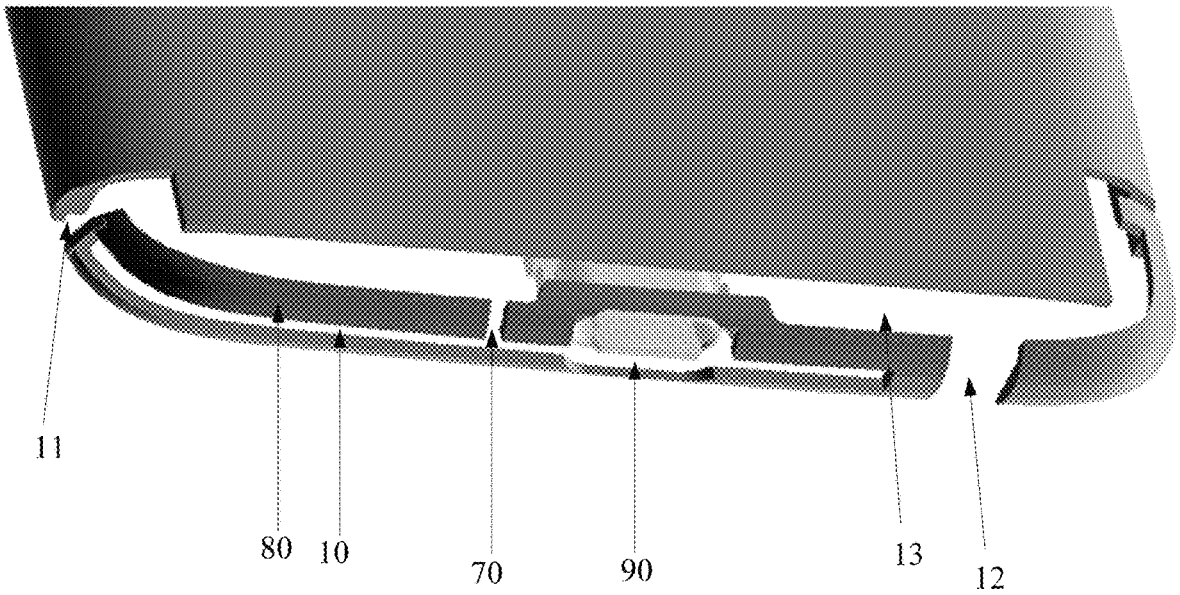
FIG. 8 is a schematic illustrating the relative positions of the first metal portion and the second isolation portion of the electronic device according to an embodiment of the present disclosure.

More specifically, based on the above embodiment, in one embodiment of the present disclosure, as shown in FIG. 8, when the housing of the electronic device is made of metal material, the second isolation portion may include the third isolation slot 11, a fourth isolation slot 12, and a fifth isolation slot 13. The third isolation slot 11 may be located on the side wall of the housing in the direction from the upper surface of the electronic device to the lower surface of the electronic device, and extend through the side wall of the housing of the electronic device; the fourth isolation slot 12 may be located on the side wall of the housing in the direction from the upper surface of the electronic device to the lower surface of the electronic device, and extend through the side wall of the housing of the electronic device; and the fifth isolation slot 13 may be located between the side wall and the bottom surface of the housing, where one end of the fifth isolation slot may be connected to the third isolation slot 11, and the other end may be connected to the fourth isolation slot 12 to form an isolation region between the third isolation slot 11, the fourth isolation slot 12, and the fifth isolation slot 13. Further, the first metal portion 80 may be disposed within the isolation region.

Figure 9:
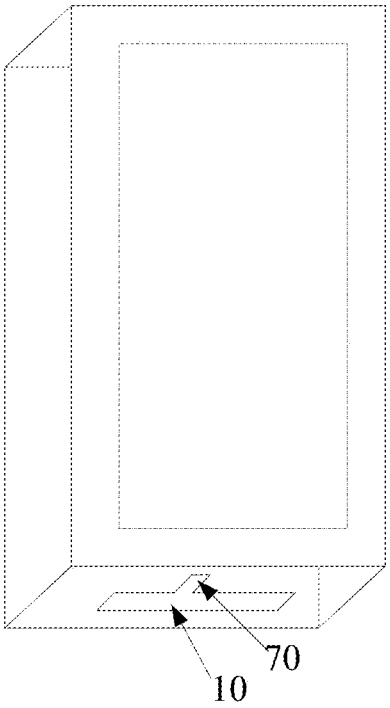
FIG. 9 is a schematic illustrating the relative positions of the first slot and the second slot of the electronic device according to still another embodiment of the present disclosure.

Based on the above embodiment, in one embodiment of the present disclosure, as shown in FIG. 8 and FIG. 9, the side surface of the electronic device may have a second slot 70 that is perpendicular to the first slot 10 located on one side of the first slot 10. Further, the first slot 10 may be axisymmetric with respect to the second slot 70. The present disclosure does not limit the specific location of the first slot 10 and the second slot 70 as they may be modified according to different use cases.

Figure 10:
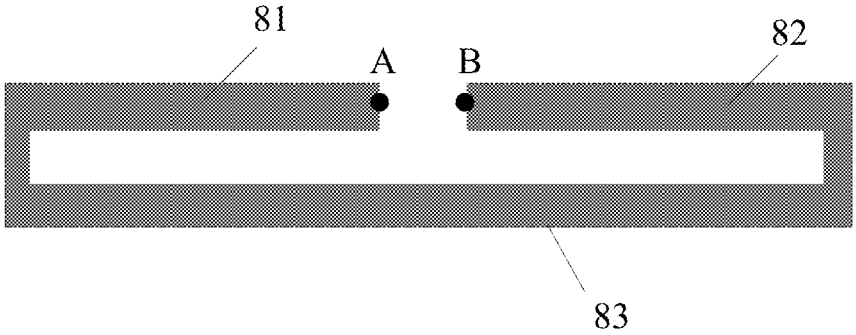
FIG. 10 is a schematic illustrating the relative positions of the first slot, the second slot, and the first metal portion of the electronic device according to an embodiment of the present disclosure.

Based on the above embodiment, in one embodiment of the present disclosure, as shown in FIG. 8 and FIG. 10, the first metal portion 80 may include a first metal branch 81, a second metal branch 82, and a third metal branch 83. The first metal branch 81 and the second metal 82 may be oppositely disposed, and one end of the third metal branch 83 may be connected to one end of the first metal branch 81 away from the second metal branch 82, and the other end may be connected to one end of the second metal branch 82 away from the first metal branch 81.

Based on the above embodiment, in one embodiment of the present disclosure, the first metal branch, the second metal branch, and the third metal branch may form a radiator of a loop antenna, where an end A of the first metal branch away from the third metal branch may be electrically connected to a feed point of the electronic device, and an end B of the second metal branch faces away from the third metal branch may be connected to a ground of the electronic device. Further, in one embodiment of the present disclosure, the first metal portion may be axisymmetric with respect to the extension direction of the second slot, and the feed point and the ground may also be axisymmetric with respect to the extension direction of the second slot, so that the first metal portion may be axisymmetric about a central axis of the line between the feed point and the ground, such that the radiator formed by the first metal portion may have an axisymmetric pattern to ensure the current distribution will not be affected by the ground, thereby enhancing the antenna performance of the electronic device.

It should be noted that in the embodiment of the present disclosure, the extension direction of the first slot may be parallel to the upper surface of the electronic device, therefore, the selection range of the length of the first slot may become longer, so that the length of the current path of the first metal portion may be increased by increasing the length of the first slot, such that the current path length of the first metal portion may correspond to the wavelength of the antenna frequency to be received, and the half wavelength radiator is not required to be disposed inside the electronic device, thereby further improving the radiation performance of the antenna of the electronic device due to the decreased clearance area.

Figure 11:
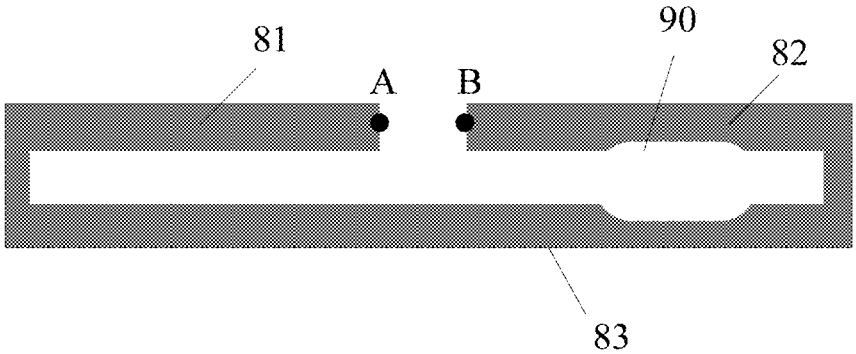
FIG. 11 is a schematic illustrating the relative positions of the first slot, the second slot, the first connector, and the first metal portion of the electronic device according to an embodiment of the present disclosure.

Based on the above embodiment, in one embodiment of the present disclosure, as shown in FIG. 11, the side surface of the electronic device may include a first port 90 located in an enclosed area formed by the first metal branch 81, the second metal branch 82, and the third metal branch 83, and the first slot 10 may extend through the first port 90 to avoid having a port on the side surface of the electronic device, and to avoid the problem that the length of the current path on the side surface of the electronic device with the port may not satisfy the corresponding wavelength of the antenna frequency to be received, which may affect the radiation performance of the antenna.

It should be noted that the first port may have a metal component, and the sensitivity of the feed point in the clearance area of the radiator is greater than the sensitivity of the ground. Therefore, based on the above embodiment, in one embodiment of the present disclosure, when the first port is located in the enclosed area formed by the first metal branch, the second metal branch, and the third metal branch, the first port may be preferably located between the second metal branch and the third metal branch to minimize the influence of the first port on the radiation performance of the radiator.

Figure 12:
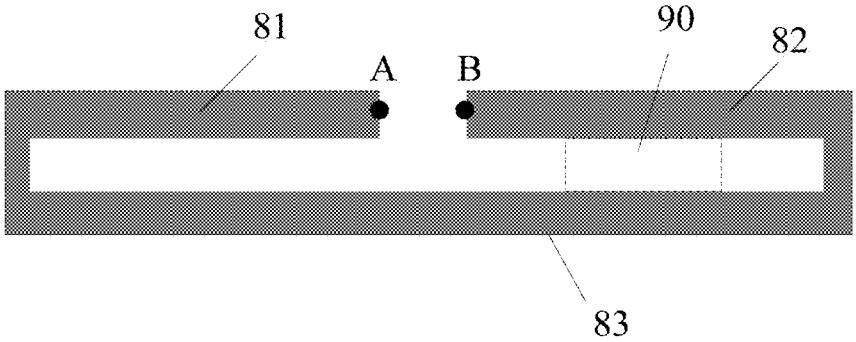
FIG. 12 is a schematic illustrating the relative positions of the first slot, the second slot, the first connector, and the first metal portion according to another embodiment of the present disclosure.

Based on the above embodiment, in one embodiment of the present disclosure, the first port may be a charging port of the electronic device (as shown in FIG. 11), or a headphone port of the electronic device, or a port to place the power button or the volume adjustment button (as shown in FIG. 12), etc. The present disclosure does not limit the use of the first port and as it may be modified under different use cases. It should be noted that in the present embodiment, the width of the first port may be greater than the width of the first slot, as shown in FIG. 11, and may be equal to the width of the first slot as shown in FIG. 12. The present disclosure does not limit the width of the first port as it may be modified under different use cases.

It should be noted that when the first port is used for the power button or the volume adjustment button, in order to provide the first metal portion with as much clearance area as possible and minimize the affect of the metal component in the first port on the radiation performance of the first antenna, in one embodiment of the present disclosure, the power button and the volume adjustment button may be plastic buttons. However, the present disclosure does not limit the material of the power button and the volume adjustment button as they may be modified under different use cases.

It should also be noted that with the development of the full-screen electronic devices, there are more and more electrical components being disposed on the lateral sides of the electronic device. Correspondingly, the metal regions are increasing denser, therefore, in one embodiment of the present disclosure, in order to provide the radiator with as much clearance area as possible, the first metal portion is preferably located at the top or bottom of the electronic device.

Based on any of the above embodiments, in one embodiment of the present disclosure, the radiator of the first antenna formed by the first metal portion may be used to receive antenna signals in the low frequency range. Further, the current path length in the first metal portion may be the wavelength corresponding to any frequency in the low frequency range. Furthermore, the current path length in the first metal portion may be the wavelength corresponding to the center frequency in the low frequency range. In another embodiment of the present disclosure, the first antenna may also be used to receive an intermediate frequency signal or a high frequency signal. Further, the first antenna may be used to receive any of the two frequency bands of the low, intermediate and high frequency signals. The present disclosure does not limit the number of frequency bands the first antenna may receive as it may be modified under different use cases.

It should be noted that due to the limited space at the top and bottom of the electronic device, when the first metal portion is preferably located at the top or bottom of the electronic device, the first metal portion should be disposed as close to one side of the electronic device as possible (such as the bottom left of the electronic device), to leave sufficient space on other side (such as the bottom right of the electronic device) of the electronic device for other components. Further, the other components may be a second antenna or other non-antenna components, which is not limited in the present disclosure. When the other components is the second antenna, the second antenna may be used to receive one or more of frequency bands of the low frequency signal, the intermediate frequency signal, and the high frequency signal.

It should also be noted since the first antenna is a symmetric antenna, that is, axisymmetrical with respect to the extension direction of the second slot, therefore, in the embodiment of the present disclosure, when the first antenna is located at the top or bottom of the electronic device near the right side or the left side of the electronic device, the radiation performance of the first antenna may not change much.

Figure 13:
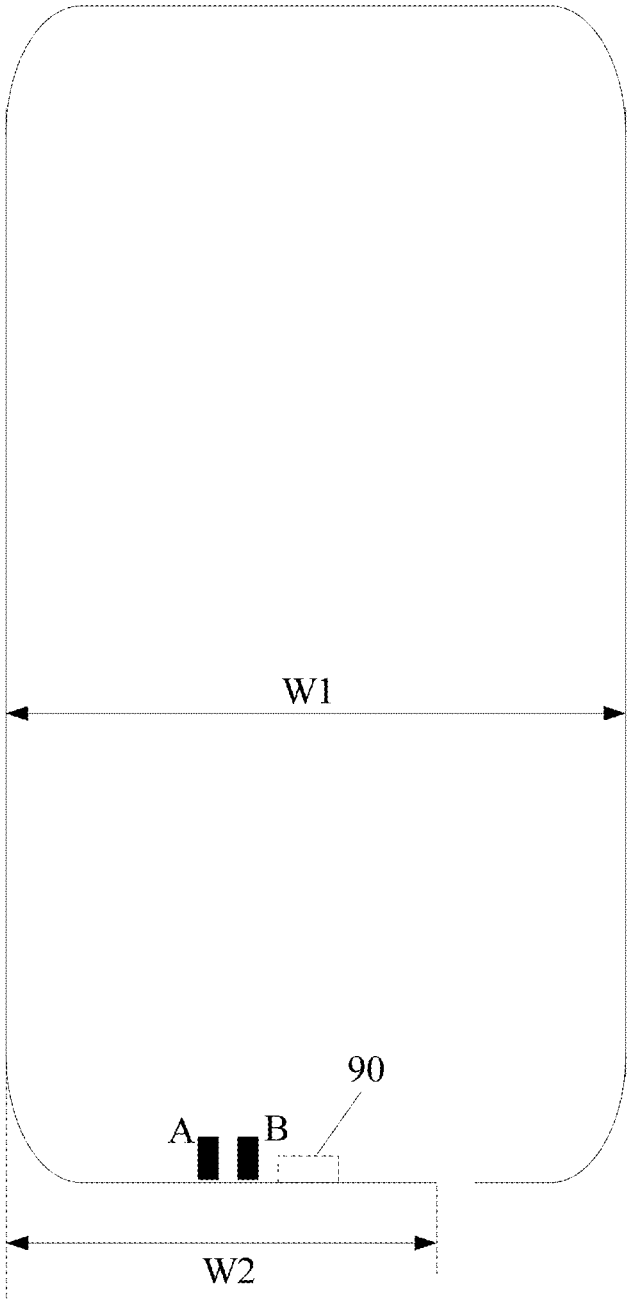
FIG. 13 is a schematic illustrating the relative position of the first antenna of the electronic device according to an embodiment of the present disclosure.
Figure 14:
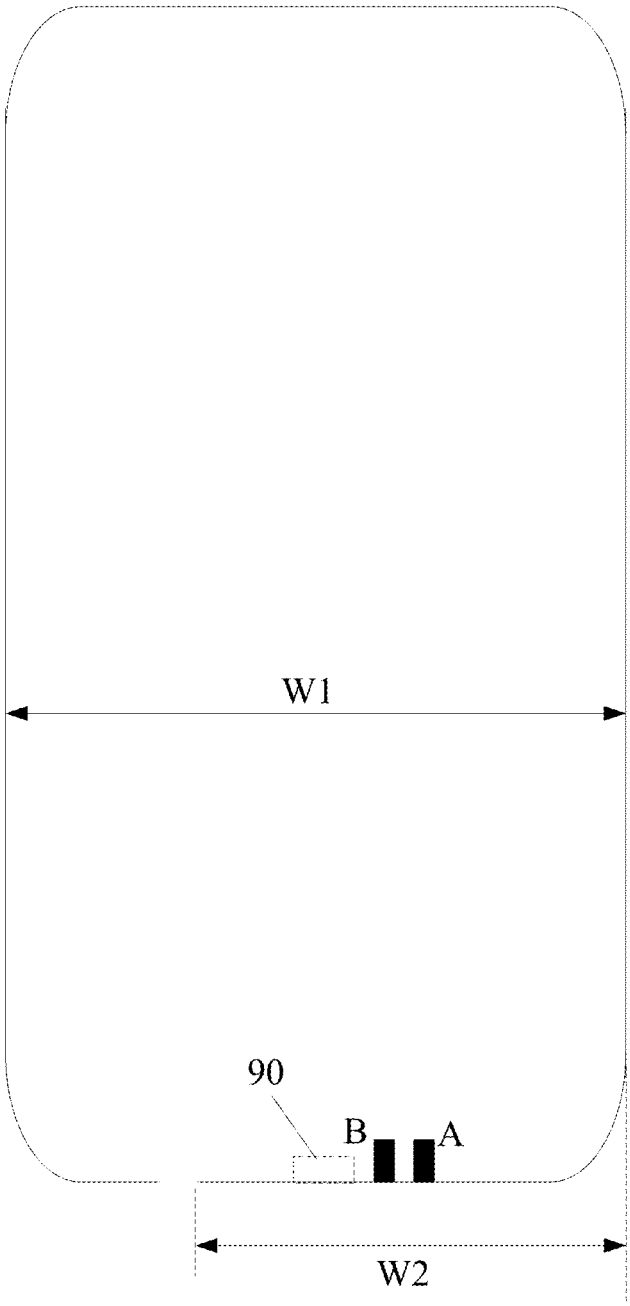
FIG. 14 is a schematic illustrating the relative position of the first antenna of the electronic device according to another embodiment of the present disclosure.

More specifically, in one embodiment of the present disclosure, the first antenna may be disposed at the bottom left of the electronic device, leaving the bottom right of the electronic device for other components, as shown in FIG. 13. Further, the first port may be located between the second metal branch and the third metal branch, and the feed point A may be located on the side of point B away the first port 90. In another embodiment of the present disclosure, the first antenna may be disposed at the bottom right of the electronic device, leaving the bottom left of the electronic device for other components, as shown in FIG. 14. Further, the first port may be located between the second metal branch and the third metal branch, and the feed point A may be located on the side of point B away the first port 90.

Based on the above embodiment, in one embodiment of the present disclosure, the side surface of the electronic device may further include a third slot and the extension direction of the third slot may be parallel to the upper surface of the electronic device; the portion of the side surface that matches the third slot may be a second metal portion that may be used as a radiator for a second antenna of the electronic device.

Figure 15:
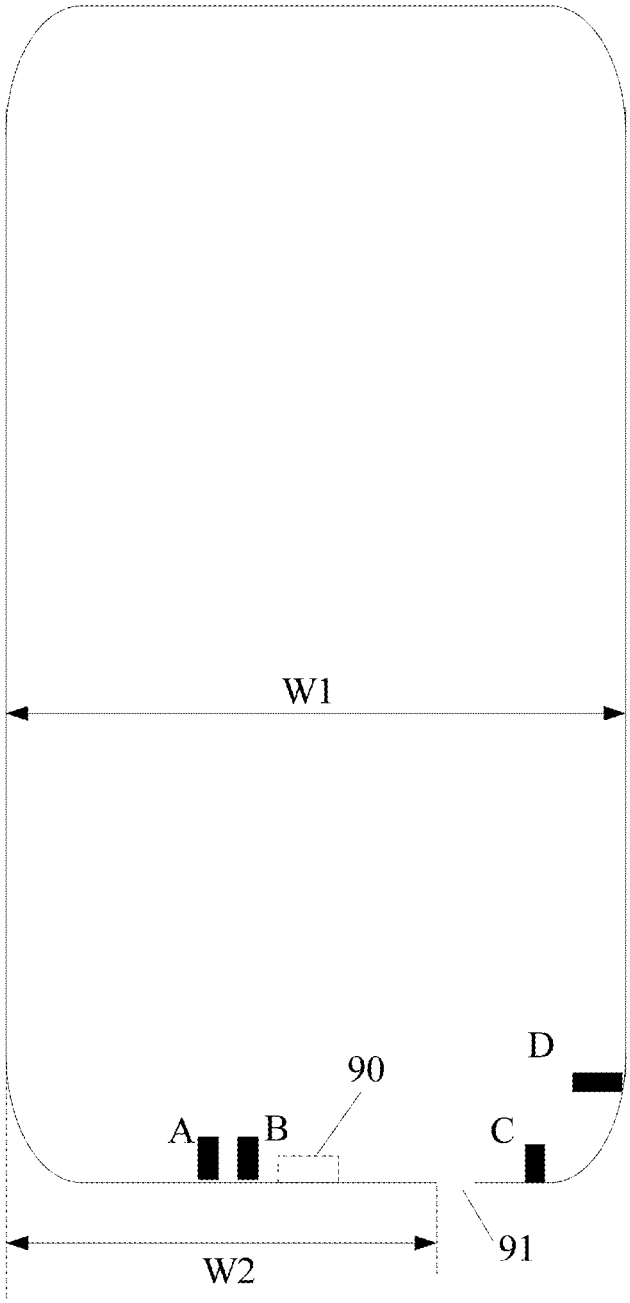
FIG. 15 is a schematic illustrating the relative positions of the first metal portion and the second metal portion of the electronic device according to an embodiment of the present disclosure.

It should be noted that when the radiators of the first antenna and the second antenna are both disposed at the top or bottom of the electronic device, due to the limit space at the top or bottom or the electronic device, based on the above embodiment, in one embodiment of the present disclosure, as shown in FIG. 15, the third slot may be located at a corner region formed by the bottom and the side surface of the electronic device, and an end C of the second metal portion may be electrically connected to the feed point of the electronic device, and another end D may be connected to the ground of electronic device.

Figure 16:
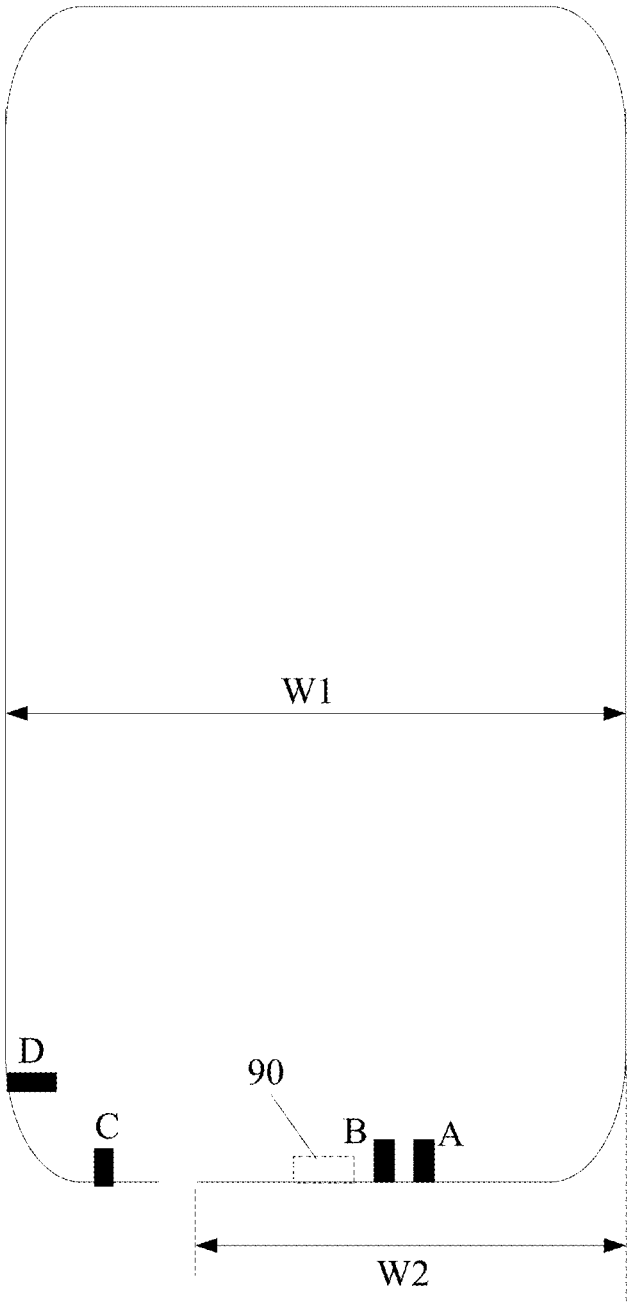
FIG. 16 is a schematic illustrating the relative positions of the first metal portion and the second metal portion of the electronic device according to another embodiment of the present disclosure.

More specifically, when the first antenna is located at the bottom left region of the electronic device, the second antenna may be located at a corner region formed by the bottom and right side surfaces of the electronic device, as shown in FIG. 15; when the first antenna is located at the bottom right region of the electronic device, the second antenna may be located at a corner region formed by the bottom and the left side surfaces of the electronic device, as shown in FIG. 16.

It should also be noted that when the first antenna and the second antenna are both disposed at the top or bottom of the electronic device, due to the limit space at the top or bottom or the electronic device, based on the above embodiment, in one embodiment of the present disclosure, the second metal portion is preferably used to receive and transmit high frequency antenna signals.

Based on the above embodiment, in one embodiment of the present disclosure, in order to minimize the interference between the first metal portion and the second metal portion, the distance between one side of the first metal portion adjacent to the second metal portion and one side of the second metal portion adjacent to the first metal portion should be no less than 5 mm. More specifically, in one embodiment of the present disclosure, the width of the electronic device W1 may be 70 mm, and the width of the first metal portion W2 may be 50 mm, and the distance between one side of the first metal portion adjacent to the second metal portion and one side of the second metal portion adjacent to the first metal portion may be 5 mm, however, the present disclosure does not limit the closet distance between the first metal portion and the second metal portion as it may be modified under different use cases.

It should be noted that in the above embodiment, in order to minimize the impact the internal circuit board may have on the antenna performance of the first metal portion and the second metal portion, in one embodiment of the present disclosure, the projection of the first metal portion on the upper surface of the electronic device does not overlap with the projection of the circuit board on the upper surface of the electronic device, and the projection of the second metal portion on the upper surface of the electronic device does not overlap with the projection of the circuit board on the upper surface of the electronic device.

Figure 17:
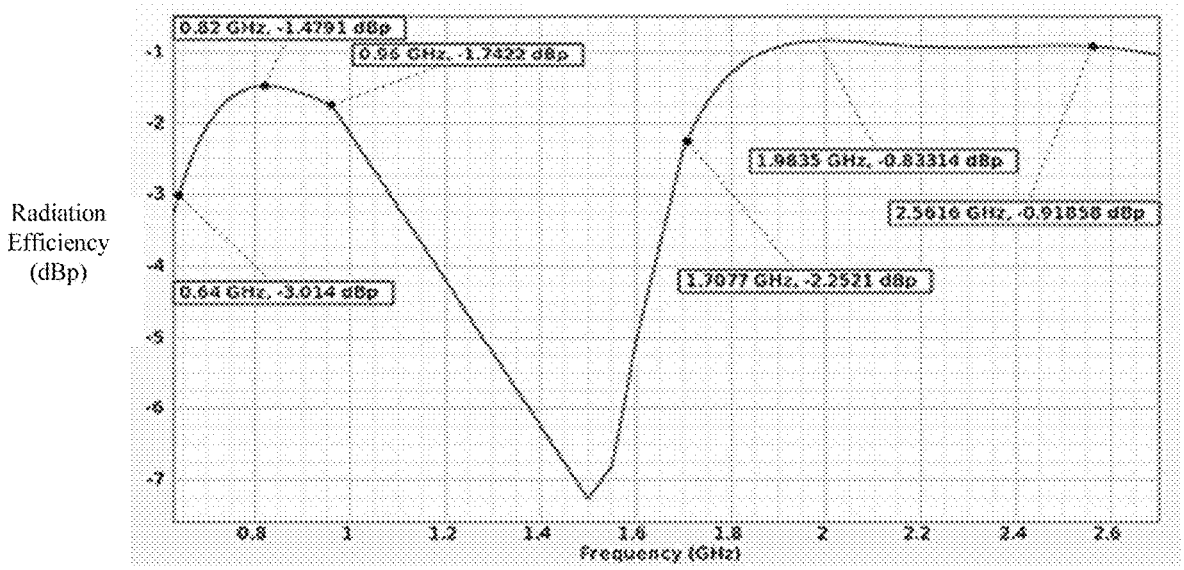
FIG. 17 is a chart illustrating the relationship between the radiation efficiency of the first antenna and the frequency of the electronic device according to an embodiment of the present disclosure.
Figure 18:
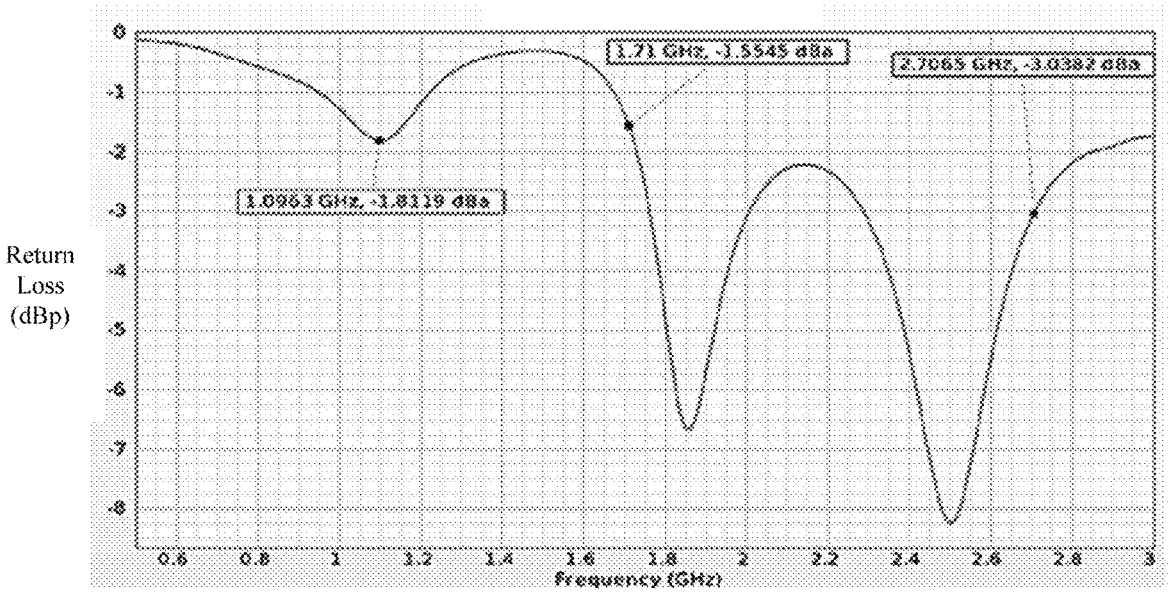
FIG. 18 is a chart illustrating the relationship between the return loss and the frequency of the electronic device according to an embodiment of the present disclosure.

As shown in FIG. 17 and FIG. 18, FIG. 17 illustrates the relationship between the radiation efficiency of the first antenna (with the corresponding frequency band between 0.64 GHz and 0.96 GHz) of the electronic device and the frequency, and FIG. 18 illustrates the relationship between the return loss of the first antenna of the electronic device and the frequency.

As can be seen in FIG. 17, in the electronic device provided in the embodiments of the present disclosure, the radiation efficiency of the first antenna is greater than −3 dpb, that is, in the electronic device provided in the embodiments of the present disclosure, the radiation efficiency of the first antenna is greater than 50%, which is considered to be highly efficient. As can be seen in FIG. 18, in the electronic device provided in the embodiments of the present disclosure, the first antenna has one or more valley in the low frequency band (0.64 GHz-0.96 GHz) and the high frequency band (1.7 GHz-2.69 GHz), respectively. Further, at the valley, the return loss of the first antenna may reach −2 dbp or lower, which may be beneficial for the impedance adjustment of the subsequent matching circuit, so that the return loss of the first antenna in the electronic device may be reduced to be lower than −10 dbp, therefore, the antenna performance of the electronic device provided by the embodiment of the present disclosure is improved.

Based on any of the above embodiments, in one embodiment of the present disclosure, the electronic device may further include an insulating decorative member disposed on a surface of the first metal portion, the insulating decorative member covering at least the first slot, the second slot, and the first metal portion to improve the appearance consistency of the electronic device, however, the embodiment provided here is not limit as coverage of the insulating decorative member may be modified under different use cases.

The electronic device such as a mobile phone provided in the embodiments of the present disclosure may have a slot along an edge of the upper surface of the electronic device, and the portion matching the slot may be the first metal portion of the housing of the electronic device, or, the portion matching the slot may be the first metal portion of the middle frame of the electronic device, where the first metal portion may be the radiator of the antenna of the electronic device. In other words, a slot may be formed in the metal portion of the housing may be used as the radiator of the antenna, and the slot may be parallel to a first edge of the upper surface of the electronic device.

The embodiments of the electronic device use the first metal portion on the side of the electronic device as the radiator of the antenna, instead of the built-in radiator, thereby improving the radiation performance of the antenna of the electronic device due to the decreased clearance area.

It will be understood by those skilled in the art that the features described in the respective embodiments and/or claims of the present disclosure may be combined in various ways, even if such combinations are not explicitly described in the present disclosure. In particular, without departing from the spirit and teaching of the present disclosure, the features described in the respective embodiments and/or claims can be combined in various ways. All of these combinations fall within the scope of the present disclosure.

While the present disclosure has been shown and described with reference to various embodiments thereof, it will be understood by those skilled in the art that various modifications in form and details may be made therein without departing from the spirit and scope of the present disclosure as defined by the appended claims and their equivalents. Therefore, the scope of the present disclosure should not be limited to the above-described embodiments but should be determined by not only the appended claims but also the equivalents thereof.

What is claimed is:

1. An electronic device, comprising: a first slot disposed along a side surface of the electronic device; a first metal portion disposed on the side surface corresponding to the first slot being used as a radiator of a first antenna of the electronic device; a second slot being perpendicular to the first slot and located on one side of the first slot the first slot is axisymmetric to the second slot: and wherein the first metal portion further includes a first metal branch, a second metal branch, and a third metal branch, wherein the first metal branch and the second metal branch are oppositely disposed, one end of the third metal branch is connected to one end of the first metal branch away from the second metal branch, and the other end is connected to one end of the second metal branch away from the first metal branch.

2. The electronic device according to claim 1, wherein:

the first slot extends in a direction that is at least partially parallel to an edge, which is a connection line between the side surface and an upper surface of the electronic device.

3. The electronic device according to claim 1, further comprising:

a protective surface; and a middle frame disposed along the edges of the protective surface to surround the protective surface;

wherein the side surface of the electronic device is the middle frame, and the first slot is a slot on the middle frame.

4. The electronic device according to claim 3, wherein the middle frame further includes a first isolation portion to isolate the first metal portion on the middle frame that corresponds to the first slot.

5. The electronic device according to claim 4, wherein the first isolation portion includes a first isolation slot and a second isolation slot, an isolation region is formed between the first isolation slot and the second isolation slot, and the first metal portion is disposed within the isolation region.

6. The electronic device according to claim 3, further comprising:

a housing, and the side walls of the housing surrounds the protective surface along the edges of the protective surface, wherein the side surfaces of the electronic device are the side walls of the housing, and the first slot is a slot on the side wall of the housing.

7. The electronic device according to claim 6, wherein the housing further includes a second isolation portion to isolate the first metal portion on the housing that matches the first slot.

8. The electronic device according to claim 1, wherein the side surface further includes a first port located between the second metal branch and the third metal branch, and the first slot extends through the first port.

9. The electronic device according to claim 1, wherein one end of the first metal branch away from the third metal branch is electrically connected to a feed point of the electronic device, and one end of the second metal branch away from the third metal branch is connected to a ground of the electronic device.

10. A method for extending a current path of a radiator of an antenna in an electrical device, comprising: placing a first slot disposed along a side surface of the electronic device; and placing a first metal portion on the side surface corresponding to the first slot being used as the radiator of a first antenna of the electronic device; placing a second slot being perpendicular to the first slot and located on one side of the first slot the first slot is axisymmetric to the second slot: and wherein the first metal portion further includes a first metal branch, a second metal branch, and a third metal branch, wherein the first metal branch and the second metal branch are oppositely disposed one end of the third metal branch is connected to one end of the first metal branch away from the second metal branch, and the other end is connected to one end of the second metal branch away from the first metal branch.

11. The method according to claim 10, wherein:

the first slot extends in a direction that is at least partially parallel to an edge, which is a connection line between the side surface and an upper surface of the electronic device.

12. The method according to claim 10, further comprising:

placing a middle frame along edges of a protective surface to surround the protective surface;

wherein the side surface of the electronic device is the middle frame, and the first slot is a slot on the middle frame.

13. The method according to claim 12, wherein the middle frame further includes a first isolation portion to isolate the first metal portion on the middle frame that corresponds to the first slot.

14. The method according to claim 13, wherein the first isolation portion includes a first isolation slot and a second isolation slot, an isolation region is formed between the first isolation slot and the second isolation slot, and the first metal portion is disposed within the isolation region.

15. The method according to claim 12, the electrical device further comprising:

a housing, and the side walls of the housing surrounds the protective surface along the edges of the protective surface, wherein the side surfaces of the electronic device are the side walls of the housing, and the first slot is a slot on the side wall of the housing.

16. The method according to claim 15, wherein the housing further includes a second isolation portion to isolate the first metal portion on the housing that matches the first slot.

* * * * *